US007952009B2

(12) United States Patent
Stannard

(10) Patent No.: US 7,952,009 B2
(45) Date of Patent: May 31, 2011

(54) NON-CONVENTIONAL USE OF CUPS IN CYMBALS

(76) Inventor: John Stannard, Clearwater, FL (US)

( * ) Notice: Subject to any disclaimer, the term of this patent is extended or adjusted under 35 U.S.C. 154(b) by 0 days.

(21) Appl. No.: 12/191,325

(22) Filed: Aug. 14, 2008

(65) Prior Publication Data

US 2009/0044683 A1 Feb. 19, 2009

Related U.S. Application Data

(60) Provisional application No. 60/956,197, filed on Aug. 16, 2007.

(51) Int. Cl.
*G10D 13/02* (2006.01)

(52) U.S. Cl. ..... 84/422.1; 84/402

(58) Field of Classification Search ..... 84/422.1, 84/422.2, 422.3, 402–410
See application file for complete search history.

(56) References Cited

U.S. PATENT DOCUMENTS 5,639,976 A * 6/1997 Manoff et al. ..... 84/402
6,617,501 B2 * 9/2003 Kaufmann ..... 84/422.3

* cited by examiner

*Primary Examiner* — Kimberly R Lockett
(74) *Attorney, Agent, or Firm* — Allen Dyer Doppelt Milbrath & Gilchrist

(57) ABSTRACT

A technique for the creation of novel sounds in cymbals and resultant cymbals through the use of multiple and/or off center cups.

15 Claims, 22 Drawing Sheets

NON-CONVENTIONAL USE OF CUPS IN CYMBALS

RELATED APPLICATION

This patent application claims the benefit of provisional patent application Ser. No. 60/956/197 filed Aug. 16, 2007.

FIELD OF THE INVENTION

This invention relates to cymbals in which cups are formed and/or located in a non-conventional manner.

BACKGROUND OF THE INVENTION

Definitions

"Overtones" are heard as simpler or individual tones or frequencies which when combined, make up the whole of a musical sound. The sum of simple sounds such as sine waves, rising and falling in amplitude and frequency can produce a complex sound. In cymbals there is often a complex matrix of overtones comprising the whole.

"Swell" is a term in music and in describing cymbal and gong sound wherein sound grows in time from low to high amplitude. In cymbals, a rise in the frequency and complexity or number of overtones accompanies the rise in amplitude.

"Attack" is the sound heard immediate after the striking of a percussion instrument. The attack is also defined as amount of time it takes for the sound of a percussion instrument to reach full volume or amplitude after a single strike. An instrument with a large amount of swell (such as a large gong struck with a soft mallet) would have a slow attack. An instrument such as a bell struck with a metal clapper or a triangle would have a fast attack.

The Definition of a "Cup" vs a Hammer Dent:

To qualify for the definition of a cup in this context, the formation should meet these criteria:

A cup as defined here could be seen as a bubble-like protrusion in the surface of the cymbal.

The protrusion could be large or slight in depth and or diameter, but a cup is large enough in diameter and protrudes deeply enough to be easily played separately in a live music situation and create an easily audible different sound from the neighboring area. The differing sound would be easily noticeable by a drummer or percussionist of normal skill.

A cup can be struck with relative ease with the shank of the drumstick if desired, as opposed to the tip of the stick, and a switching back and forth in striking the cymbal between the shank of the stick on the cup and the tip on the main body of the cymbal can be easily achieved by a drummer of ordinary skill in a live music performance.

A cup is localized in area, as opposed to a series of relatively evenly formed hammer dents, or formed grooves which cover large percentages of the cymbal surface.

With the exception of "splash" style cymbals of less than 10 inches in diameter, a cup is not to exceed a diameter of more than 50% of the total diameter of the cymbal.

A small cup is an isolated formation which contributes minimal stiffening to the overall cymbal. When spaced far enough apart, a multiple array of such small cups could still have minimal stiffening effect.

Non-conventional cup utilization can be seen as one or more cups which are located off center, and/or in a series of multiple cups, and/or compound cups, and/or cups located within other cups.

PRIOR ART

Cymbals in the past have featured a single raised area, depression, or area of decreased radius in the center of said cymbals. The area can be seen as a protruding dent which extends from the surface of the cymbal to form what is commonly known as a "cup". The cup is also sometimes known as a "bell". Cups in prior art have been formed of many sizes and have been formed either downward (opposing the convex surface of the cymbal) or, more commonly, upward (in the same direction as the main convex curve).

Prior cups have always been centrally located. The purpose of the cups was to increase volume, and/or alter overtone structure, and/or create a swelling or "crescendo" sound and/or provide an alternate playing surface in which a brighter bell-like sound could be achieved.

Prior Art Flatride Cymbals:

Prior art "flatride" cymbals have no cup at all. These cymbals are of a lower amplitude and are used often in jazz music. One of the features of of flatride cymbals is the deliberate limitation of overtone buildup or crescendo and an increased quality of "stick definition" in which the actual sound of the vibrating drumstick and it's interaction with the cymbal is allowed to be heard more clearly. This invention can embody a cymbal with a small cup placed off center which does not eliminate the flatride qualities of the cymbal such as minimal swell and increased stick definition. When played separately, such an off center cup provides a different sound than the main body of the cymbal, but does not add a clear bell-like sound. Such an embodiment, is highly useful in many musical settings.

SUMMARY OF THE INVENTION

This invention offers a technique for the creation of novel sounds in cymbals through the use of multiple and or off center cups.

One important difference between this invention and prior art is that the cups defined in this invention can, if desired, have very little impact on the overall rigidity of the instrument, especially when the cups are of a small diameter. When of a small diameter, the cups can be of considerable depth without affecting overall rigidity. They can, as a result have a limited and controlled affect on the general sound of the instrument, while still allowing a distinctly differing sound to be produced when they are directly struck on the added cup.

By carefully locating small cups with sufficient distance apart from each other, minimal change in rigidity occurs.

While playing hammer dents on deeply hammered cymbals in prior art can produce extremely subtle differences in tone from surrounding areas simply due to a change in the location struck by the drumstick, the striking of the one or more cups mentioned in this invention can produce instantly recognizable differences in sound. This invention, by creating defined non-conventional cups, also provides striking surfaces which can be easily located and played in real world music settings such as live music and fast paced studio environments.

An advantage to this invention is that the addition of as few as one small cup can provide an area where the different sounds can be produced without loss of tone quality to the rest of the cymbal.

The cups can also be formed in a manner for general alteration of tone (even when not struck directly). Tone qualities such as stick definition, sustain, overtone structure, and swell could all be manipulated through various embodiments of this invention.

The thickness of each cup section can differ using various manufacturing techniques involving material removal, forming, or welding. This would affect the distinct sound of each cup section and alter the overall sound of the instrument in some cases.

Shape of Cups:

The most common shape of cymbals and their cups is a round, domed shape. While not limited to purely round cymbals, this invention allows novel changes to cymbals while allowing the cymbal to retain aspect of conventional round cymbal shapes.

In an industry where sound innovation is constantly sought after with the application of ultra small changes in the cymbal designs, the industry has nevertheless never adapted a radical change in cymbals as contemplated by the present invention. Accordingly, there has been a long felt need for a more radical change in cymbals, such as found in the present invention.

Various Cups Described:

Compound Cups:

In the case of a small inverted cup located in the center of a main large center cup, the small inverted cup can alter the general cup sound but also reduce the surface area on which the cymbal rests on a cymbal felt. This reduced bearing surface reduces damping and can allow the cymbal to vibrate more freely.

In the case of small secondary cups which are located at points along the outer area of the main center cup, the small cups can serve to reduce high frequencies and also provide an alternate striking surface.

The welding of additional metal inside secondary cups can add mass which can alter sound considerably, depending on the location of the secondary cups.

Two or more secondary cups can be located in a manner which allows a drumstick technique called raking.

One or more off center inverted cups can result in very "dark" and rich tones in cymbals. Such cymbals emit a complex range of overtones in the low to low-midrange frequency range yet unheard in prior art.

Large off center cups can provide a distinct alternate playing surface which emits a unique sound quite unlike the bell-like tone of a conventional center cup.

Groupings of small cups near the center of a cymbal can alter swell and amplitude.

A compound center cup with a small, deep center cup of very small diameter, can alter the center of gravity and hence stabilize balance in a cymbal. Such a cup, if small enough in diameter could have minimal tonal impact on the cymbal or main cup.

Multiple Cups to Achieve and Control Vibrato.

Prior art cymbals have a relatively rigid feel. While thin cymbals do "flex" easier than thick cymbals, thin cymbals still feel relatively tight and stable. By adding small cups or depressions in an upward direction (the same direction as the convex bow of the cymbal), an effect known in metal working as "loosening" can occur. This loosening causes the novel effect of vibrato.

The vibrato can be controlled by the location, depth and diameter of these depressions. Conventional cymbal making teaches away from such a metal working practices. Prior art cymbals, including handmade cymbals, feature a relatively tight feel. Despite the trend toward promotion of hand hammering in some models of prior art cymbals, the cymbals still maintain a tight feel with no vibrato.

Nickel-Iron Grain Refiners in Bronze to Allow Formation of Deeper and Stronger Cups without Cracking.

Ductility and strength are necessary to form the cups in this invention. In many alloys, the metal is quite ductile (easily deformed without cracking or failure) when in the soft or partially softened state. These softer states of metal, while quite ductile, are not as strong as the hardened levels of temper in any given alloy. Temper ratings of certain alloys, especially those which are strengthened through cold work methods such as rolling, hammering or other methods which can reduce the thickness of said metal and reduce grain size and elongate the grain structure of the alloy, are rated by the percent of elongation remaining in the alloy before the metal will fail in tension.

Phosphor bronze is hardened and strengthened by cold work. Phosphor bronze alloys are typically composed of copper, tin and a small amount of phosphorous. A typical phosphor bronze, when hardened to a strength rating of extra spring temper, can only be elongated by an additional 2% before failing and breaking or cracking in tension.

The addition of small amounts of iron and nickel can refine and reduce grain size and hence, increase strength. Through the addition of the iron and nickel, ideally in ranges of between 0.05 to 0.20% each, strength is increased considerably. By utilizing these grain refiners, a temper with more elongation remaining in the alloy can be used.

A temper rating of extra hard in such an alloy, will possess strength equal to extra spring in a typical bronze alloy. This extra hard temper can be elongated considerably more than extra spring temper hence allowing the deformation needed to easily form this invention.

In short, a softer more ductile temper of grain refined bronze can be stronger than a hard, more brittle temper of traditional bronze.

While nickel iron grain refiners are known to increase low tin bronze strength, they are not known to increase sound quality. Low tin bronze alloys is thought to be high pitched, and of narrow range compared to equal high tin alloys in sound quality. The inventor has found that by using nickel iron grain refiners in low tin, more affordable and workable alloys, a percussion or cymbal maker can increase taper, use of heat zones, depth and greater variations of hammering and other processes which create a structurally more complex instrument to realize a product of superior complexity of overtone structure, higher strength and a product which lends itself to greater affordability of quality control. Such processes such as greatly increased tapering would weaken common alloys but the added strength provided by nickel iron grain refiners allows the use of these special processes and features.

Advertising copy from the two largest cymbal manufacturers teaches away from use of low tin alloys for high quality percussion instruments by mentioning that their own product lines made of low tin alloys are of affordable, mass produced and identical quality when compared to their high tin alloy products: reference—Sabian.com advertising in referring to low tin alloy called B8 phrases point to an image of affordability, "rapid tech virtual cloning". Limited range of overtone structure is advertised: "focused sound," "Lowest possible prices," all teach away from low tin alloys for use in quality cymbals and percussion.

The Zildjian company (the largest cymbal maker) advertises "ultra modern crafting techniques", "higher pitch", "more focused overtones", "identical discs". Such phrases teach away from very high quality to cymbal and percussion consumers, who regard hand crafting and a wider range of overtones desirable, as currently described in its Web site at http://www.zildjian.com/us-US/products/default.ad2.

Conversely the same companies promote their high tin products as works of art with centuries old secret processes which yield high quality, all of which begins with their 20% tin alloy. The use of nickel-iron grain refiners in this invention offers a method to create new hybrid and vibrato based instrument embodiments of high quality and novel sound while possessing the superior flexural strength needed for this invention.

The use of nickel iron grain refiners allows an unprecedented degree of formability which results in the unexpected sound derived from said deeply formed, highly localized cups.

Various Embodiments Include:

1. A cymbal comprising two or more cups.
2. A cymbal wherein one or more of the cups are located off center from the main center of the cymbal.
3. A cymbal wherein one or more of the cups feature metal welded inside the cup.
4. A cymbal wherein one or more smaller cups are formed within the main center cup at locations not located in the center of the main cup.
5. A cymbal wherein one or more smaller cups are formed within the main center cup and wherein the smaller cups are located centrally within the main cup.
6. A cymbal wherein the combination of two or more small added cups in proximity allow a sideways drumstick playing technique known as raking.
7. A cymbal wherein one or more cups have an inverted form in the main convex surface of a cymbal.
8. A cymbal wherein groupings of small cups in the center area affect swell and amplitude.
9. A cymbal wherein the addition of one or more smaller cups formed within the main center cup are located centrally within the main cup, and wherein the cups could form one or more dome shapes of opposing direction from each other.
10. A cymbal wherein the addition of nickel/iron grain refiners added to phosphor bronze enhances formability and hence enhances sound potential in cymbals with multiple cups.
11. A cymbal wherein a series of small cups in an upward direction (the same direction as the convex bow of the cymbal), result in a vibrato effect.
12. A cymbal wherein one of the cups is a concave downward facing cup centered within an upward facing cup, therein allowing a smaller center surface contact area, hence reducing damping.
13. A cymbal wherein a series of small cups are located to form a predetermined pattern on the cymbal.
14. A cymbal wherein a series of small cups are located to create one or more S-shaped groupings.
15. A cymbal wherein a series of small cups are located to create a spiral pattern extending outward from center.
16. A cymbal wherein a deeper center cup is surrounded by a series of cups which progress outward from center with gradually or progressively changing depth.
17. A cymbal wherein a larger diameter center cup is surrounded by a series of cups which progress outward from center with gradually or progressively changing diameter.
18. A cymbal wherein a deeper centrally located small cup is located within the main cup or main body of a cymbal, and wherein the center cup by way of its increased depth stabilizes balance in the cymbal, especially those types of cymbals known as suspended cymbals.
19. A cymbal with at least one off center cup.

BRIEF DESCRIPTION OF THE DRAWINGS

In the accompanying drawings.

DETAILED DESCRIPTION OF THE INVENTION

Figure 1A:
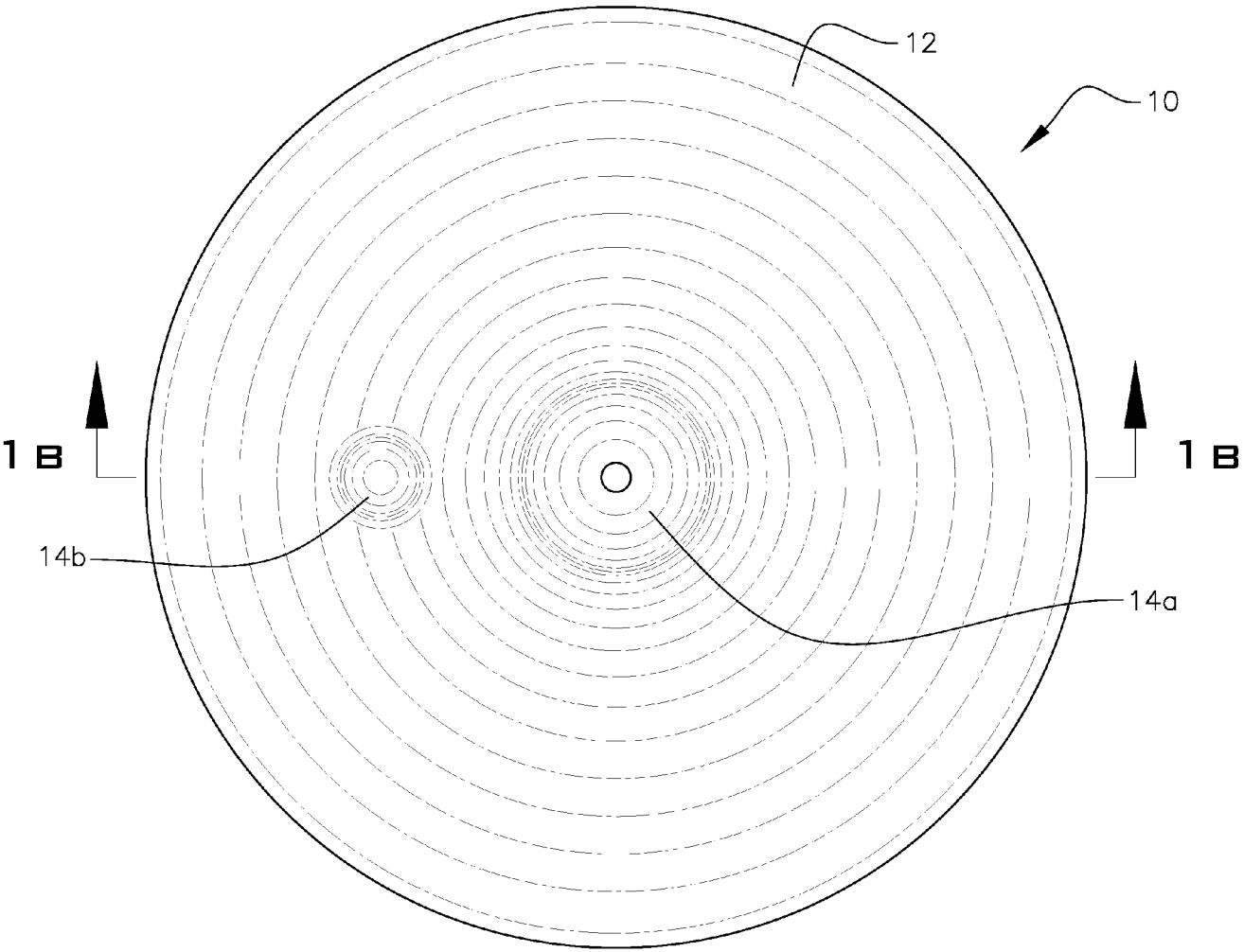
FIG. 1A is a representative depiction of a cymbal with multiple cups, one being a center cup, any remaining cup being off-center.

Referring now to the drawings, depicted are examples of the present invention using one or more cups centrally located or off-centered on a cymbal 12. The invention is depicted generally as 10.

Figure 1B:
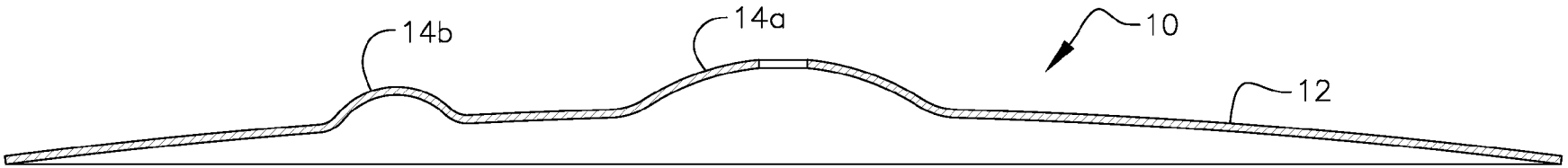
FIG. 1B is a cross-section view of the depiction of FIG. 1A.

More specifically as depicted in each of the drawings:

FIG. 1A is a representative depiction of a cymbal 12 with multiple cups, one being a center cup 14*a*, any remaining cup 14*b* being off-center and FIG. 1B is a cross-section view of the depiction of FIG. 1A. Center cup 14*a* depicts an aperture for mounting the cymbal 12 to a cymbal stand (not shown). Although a single off center cup 14*b* is shown by way of example, it is understood that the depiction is also representative of more than one off center cup 14*b* located in predetermined or desired locations on the cymbal 12.

Figure 2A:
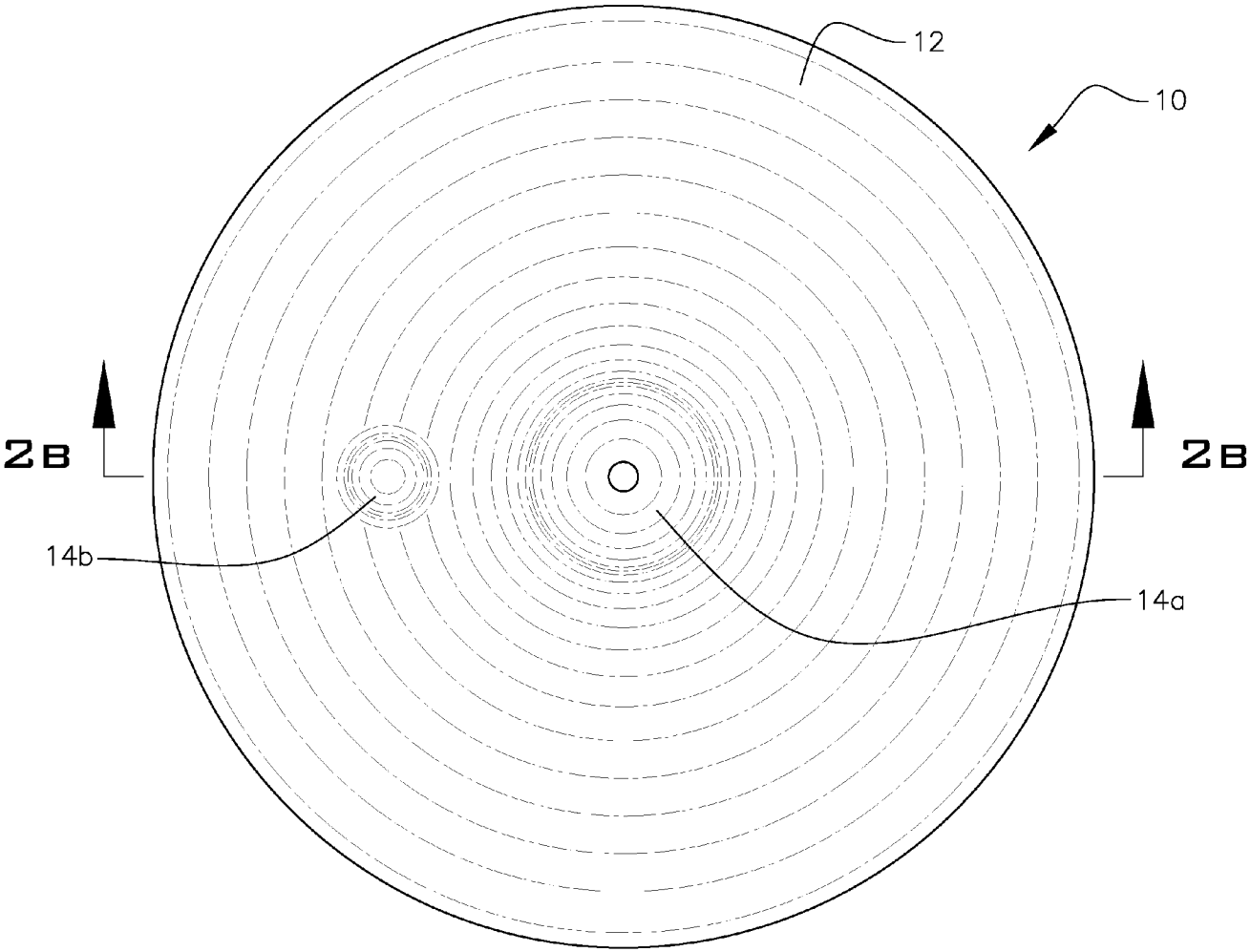
FIG. 2A is a representative depiction of a multiple cup cymbal similar to that depicted in FIGS. 1A-1B, where a metal material is welded inside one of the cups.
Figure 2B:
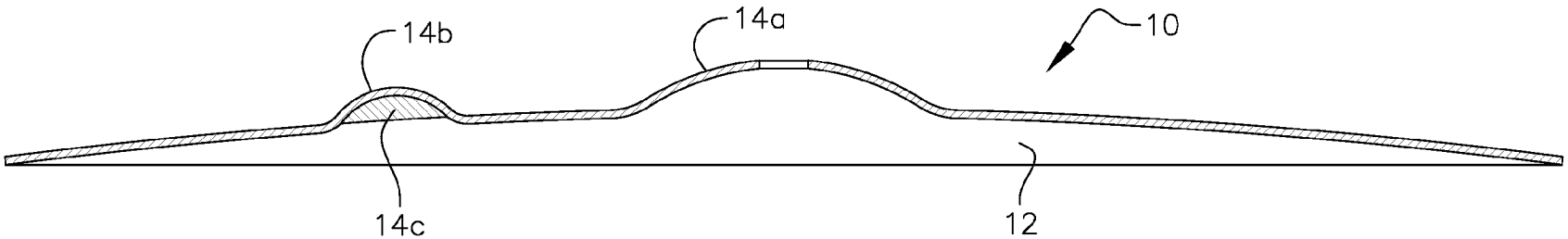
FIG. 2B is a cross-section view of the depiction of FIG. 2A.

FIG. 2A is a representative depiction of a multiple cup cymbal 12 similar to that depicted in FIGS. 1A-1B, where a metal material 14*c*, as depicted in FIG. 2B is welded inside one of the cups 14*b*.

Figure 3A:
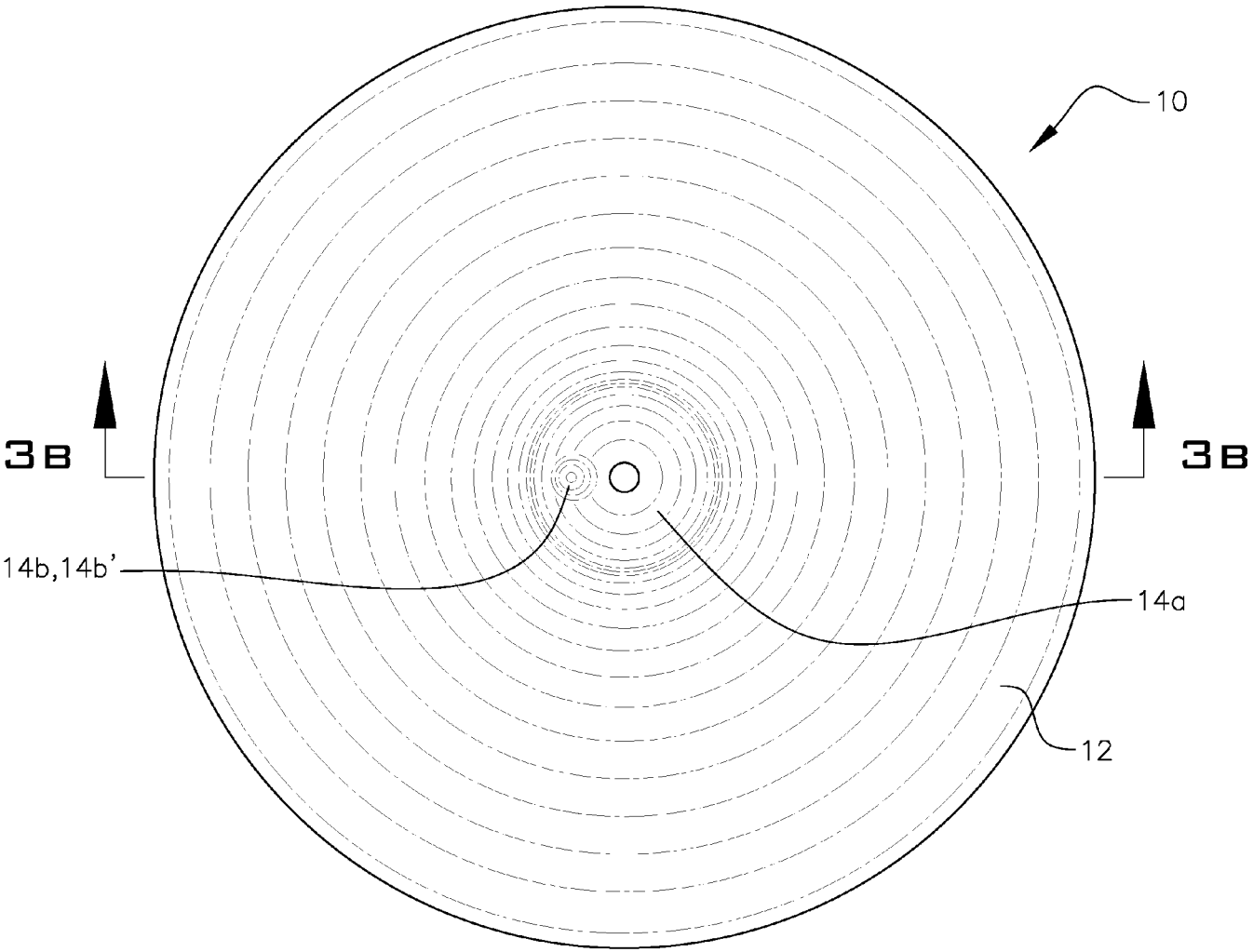
FIG. 3A is a representative conceptual drawing depicting multiple cups where one cup is a center cup with an off center cup within the main center cup.
Figure 3B:
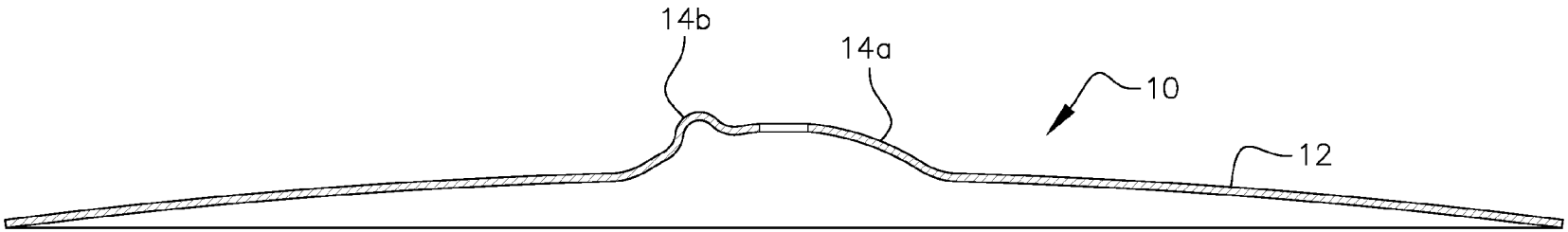
FIG. 3B is a cross-section view of FIG. 3A depicting an upwardly directed cup within the main center cup.
Figure 3C:
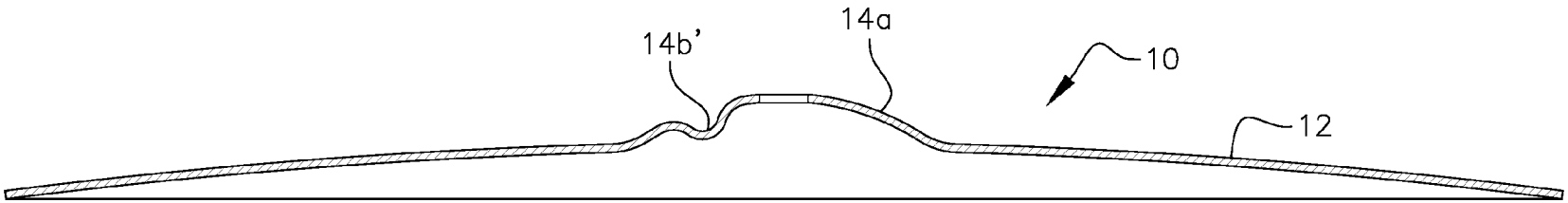
FIG. 3C is a cross-section view of FIG. 3A depicting a downwardly directed or inverted cup within the main center cup.

FIG. 3A is a representative conceptual drawing of a cymbal 12 depicting multiple cups where one cup is a center cup 14*a* with an off center cup within the main center cup 14*a*. FIG. 3B is a cross-section view of FIG. 3A depicting an upwardly directed cup 14*b* within the main center cup 14*a*. and FIG. 3C is a cross-section view depicting a downwardly directed or inverted cup 14*b*' within me main center cup 14*a*.

Figure 4A:
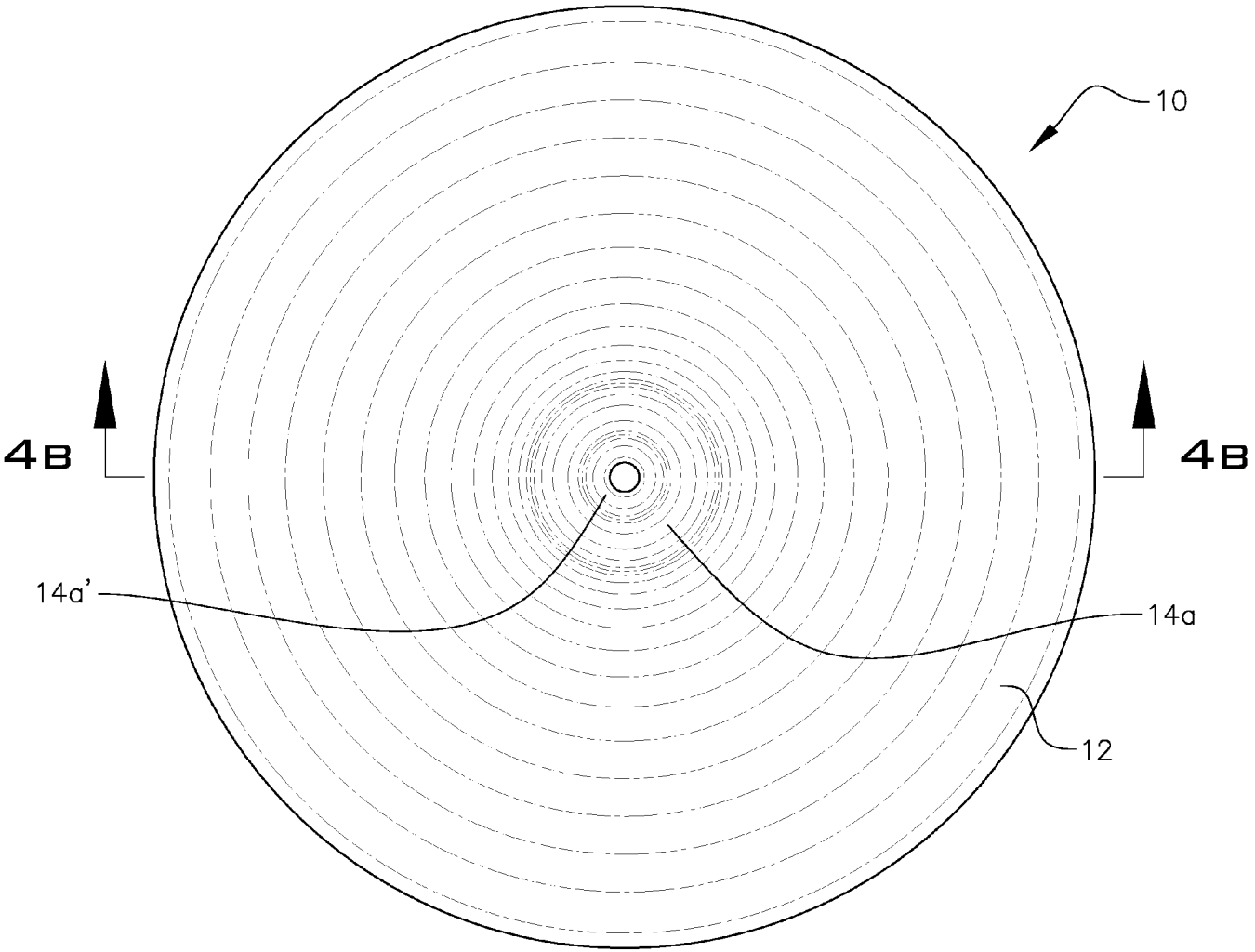
FIG. 4A is a representative depiction of multiple concentric cups where one or more smaller cups are located centrally within the main center cup.
Figure 4B:
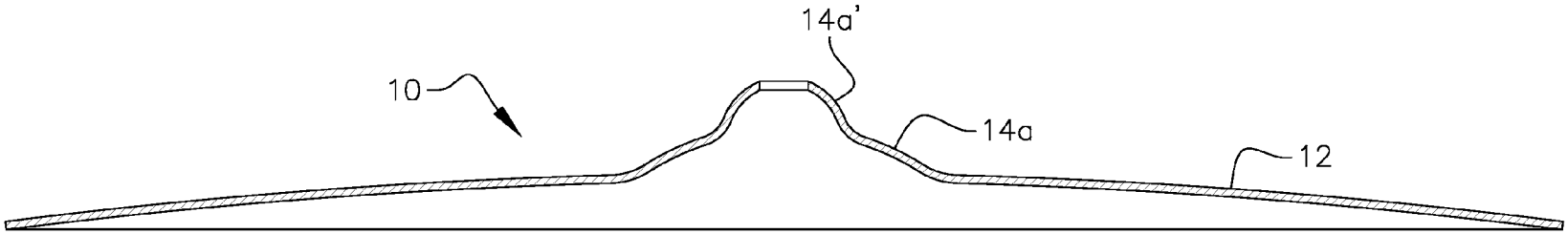
FIG. 4B is cross-section view of FIG. 4A depicting an upwardly directed cup concentrically located within the main center cup, and the drawing further depicts an example of where the center cup by way of its increased depth stabilizes balance in the cymbal, especially those types of cymbals known as suspended cymbals.
Figure 4C:
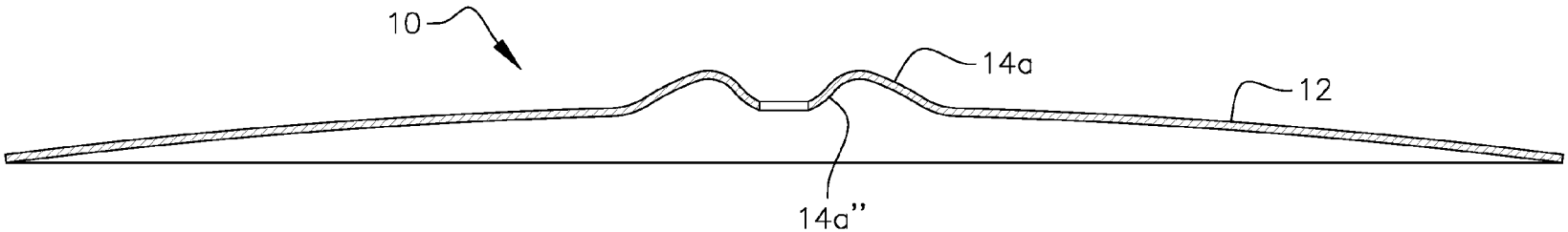
FIG. 4C is a cross-section view of FIG. 4A depicting a concentric downwardly directed or inverted cup within the main center cup and the drawing is also representative of a cymbal wherein the addition of one or more smaller cups formed within the main center cup are located centrally within the main cup, and wherein the cups form one or more dome shapes of opposing direction from each other, and the drawing is also representative of a cymbal wherein one of the cups is a concave downward facing cup centered within an upward facing cup, therein allowing a smaller center surface contact area, hence reducing damping.

FIG. 4A is a representative depiction of multiple concentric cups where one or more smaller cups 14*a*' are located centrally within the main center cup 14*a*. Although the depiction shows on concentric cup 14*a*', it is understood that additional progressive cups 14*a*' may be added. FIG. 4B is cross-section view of FIG. 4A depicting an upwardly directed cup 14*a*' concentrically located within the main center cup 14*a*, and the drawing further depicts an example of where the center cup by way of its increased depth stabilizes balance in the cymbal 12, especially those types of cymbals known as suspended cymbals. FIG. 4C is a cross-section view of FIG. 4A depicting a concentric downwardly directed or inverted cup 14*a*" within the main center cup 14*a* and the drawing is also representative of a cymbal wherein the addition of one or more smaller cups 14*a*" formed within the main center cup are located centrally within the main cup 14*a*, and wherein the cups form one or more dome shapes of opposing direction from each other. The drawing is also representative of a cymbal wherein one of the cups is a concave downward facing cup centered within an upward facing cup, therein allowing a smaller center surface contact area, hence reducing damping.

Figure 5A:
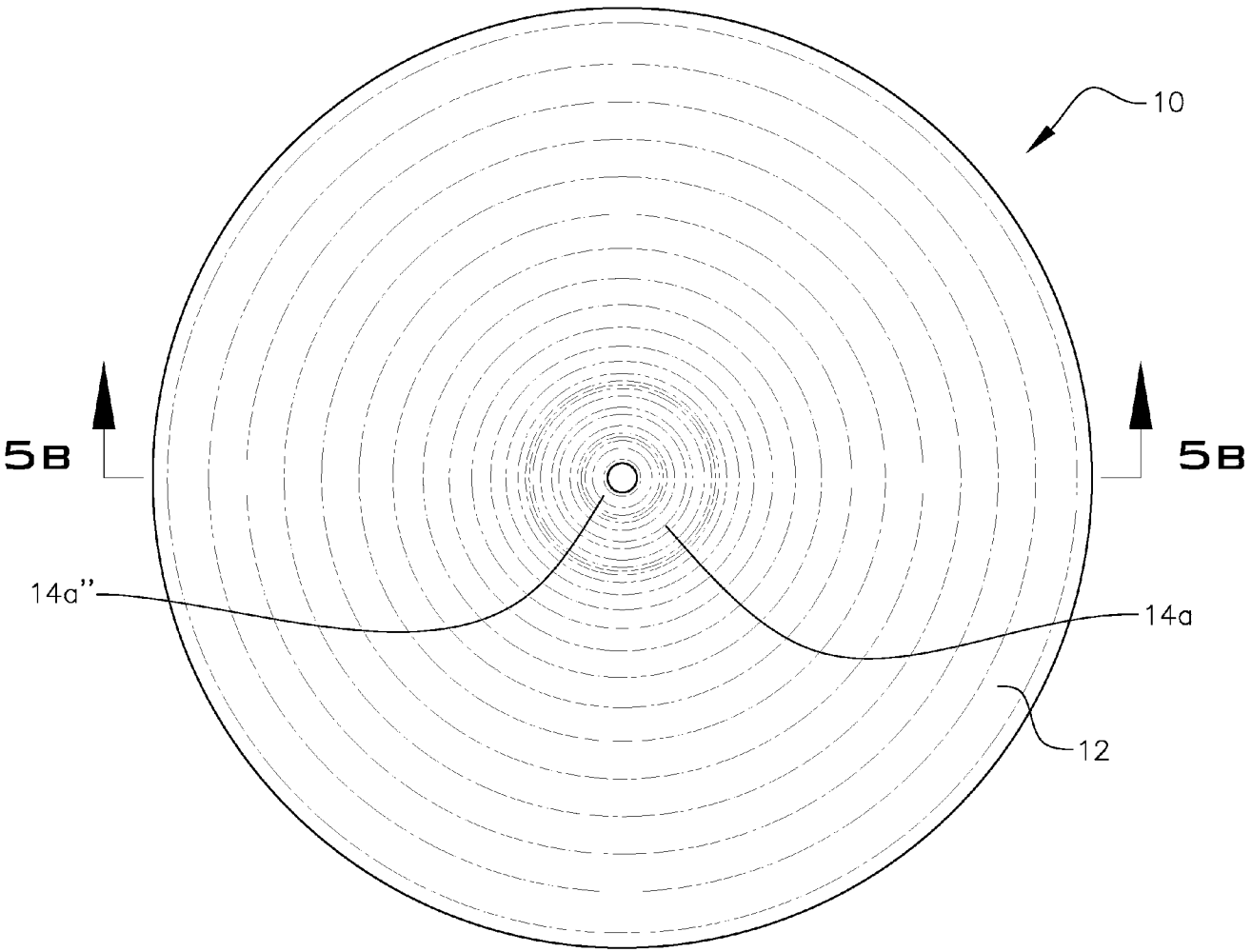
FIG. 5A is a representative conceptual depiction showing concentric downwardly directed cups.
Figure 5B:
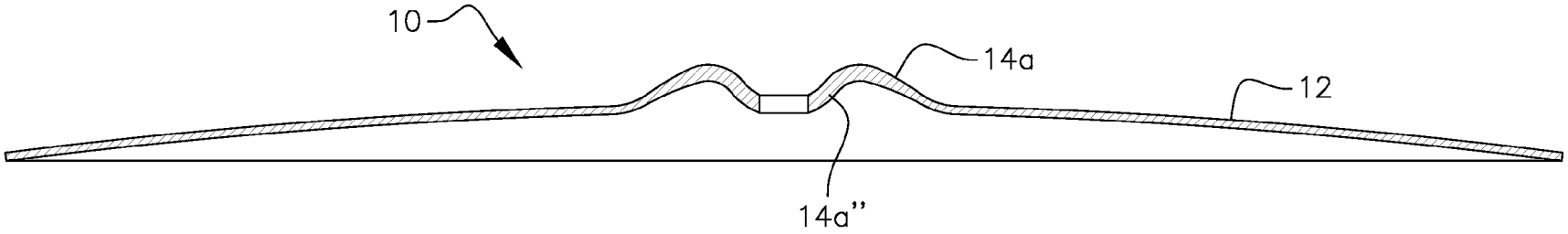
FIG. 5B is a cross-section view of FIG. 5A showing that the concentric downwardly directed or inverted cup has a thicker portion and wherein a deeper centrally located small cup is located within the main cup or main body of a cymbal.

FIG. 5A is a representative conceptual depiction showing concentric downwardly directed cups 14*a*, 14*a*" with FIG. 5B being a cross-section view of FIG. 5A showing that the concentric downwardly directed or inverted cup 14*a*" has a thicker portion and wherein a deeper centrally located small cup 14*a*" is located within the main cup 14*a* or main body of a cymbal 12.

Figure 6A:
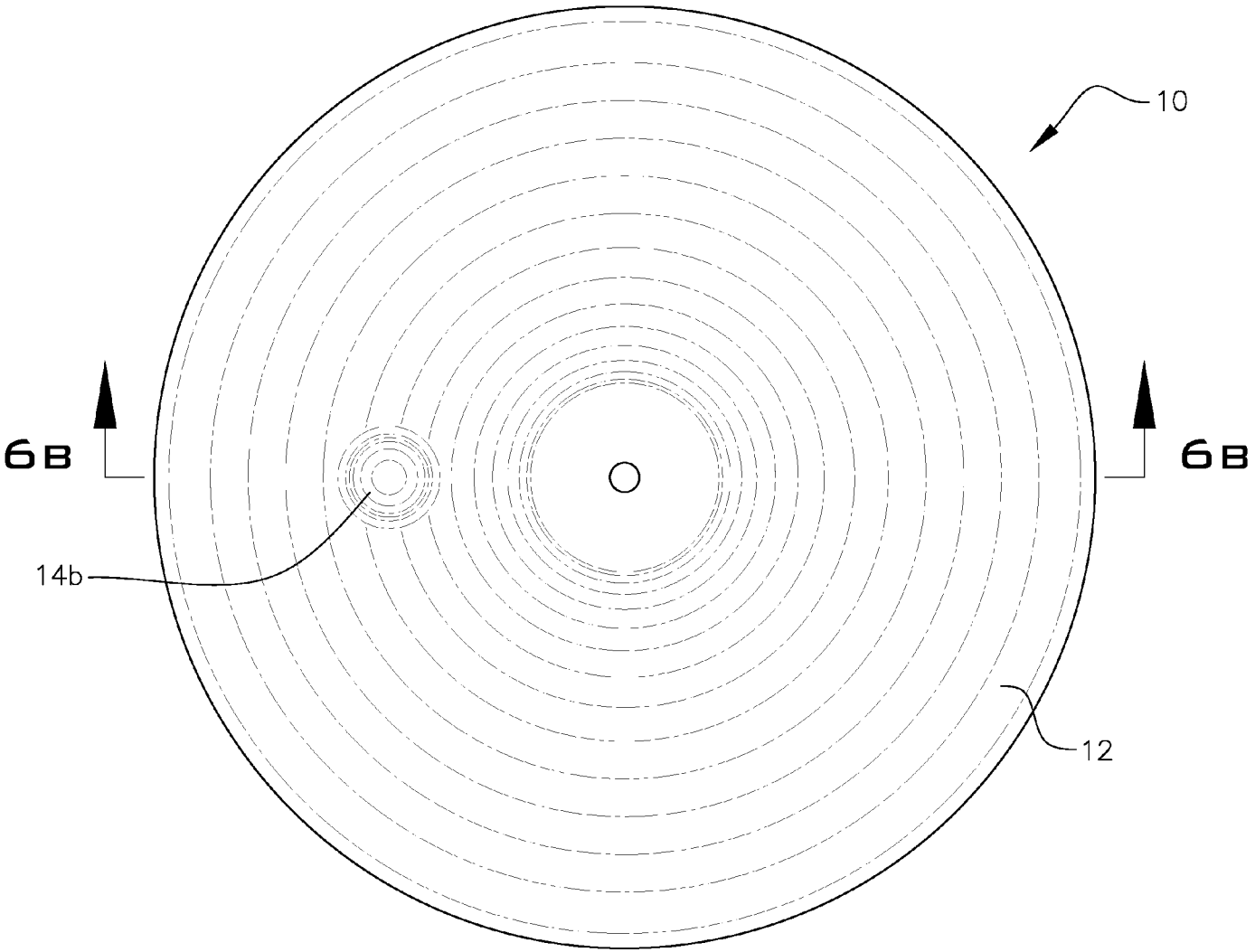
FIG. 6A is a representative conceptual depiction of one embodiment of the invention where the cymbal includes one or more off center cups.
Figure 6B:
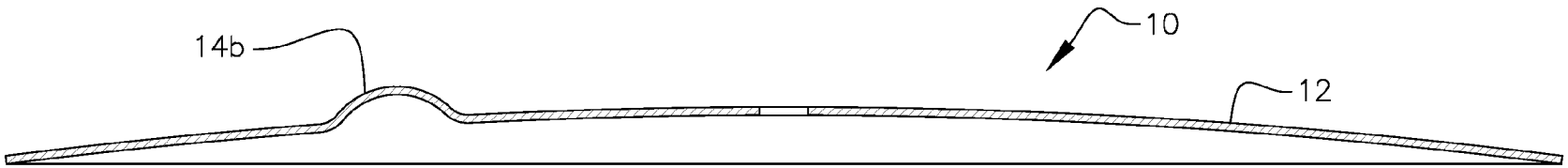
FIG. 6B is a cross-section view of FIG. 6A with the off center cup(s) being concave upwardly directed.
Figure 6C:
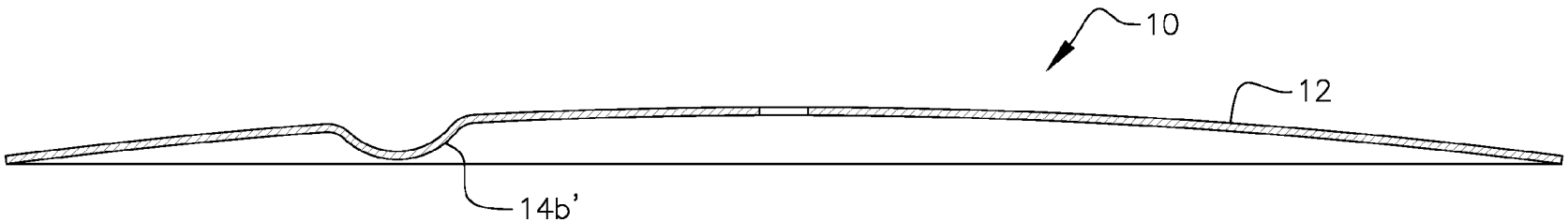
FIG. 6C is a cross-section view of FIG. 6A with the off center cup(s) being downwardly directed or inverted.

FIG. 6A is a representative conceptual depiction of one embodiment of the invention 10 where the cymbal 12 includes one or more off center cups 14*b*. The cymbal 12 does not have a center main cup. The off center cup 14*b* may be upwardly directed as depicted in FIG. 6B or the off center cup 14*b*' may be downwardly directed or inverted as depicted in FIG. 6C. Although the depiction show one off center cup, it is understood that more than one off center cup is contemplated as the drawing is a representative sample of the embodiment.

Figure 7A:
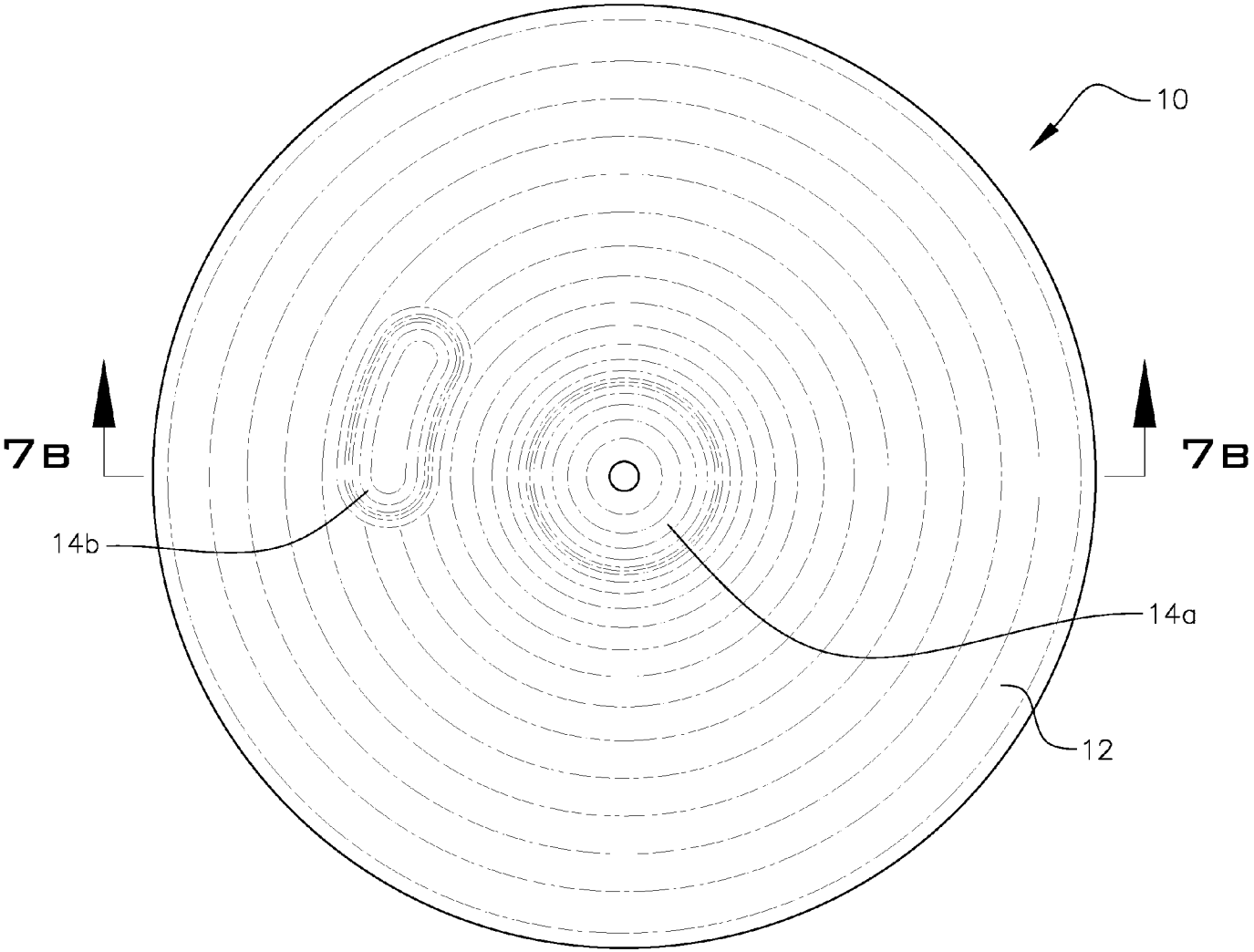
FIG. 7A is a conceptual representative drawing depicting multiple cups with one center cup and one or more off center cups except that at least one of the off center cups is a partial annular ring shape configuration (upwardly or downwardly directed)
Figure 7B:
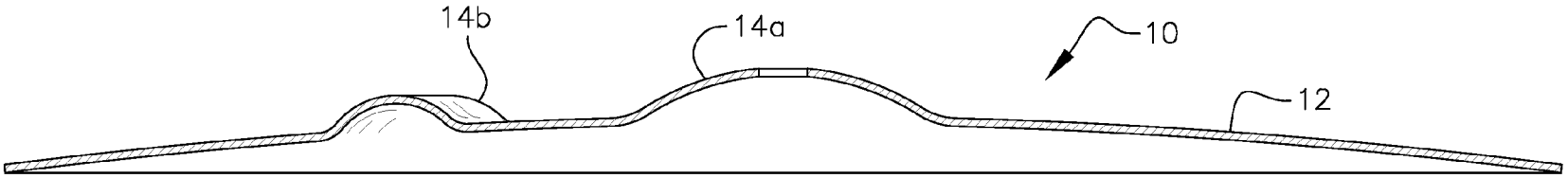
FIG. 7B is a cross-section view of the depiction of FIG. 7A showing an upwardly directed partial annular ring shape configuration.

FIG. 7A is a conceptual representative drawing depicting multiple cups with one center cup 14*a* and one or more off center cups 14*b* except that at least one of the off center cups 14*b* is a partial annular ring shape configuration (upwardly or downwardly directed), and FIG. 7B is a cross-section view of the depiction of FIG. 7A showing an upwardly directed partial annular ring shape configuration.

Figure 8A:
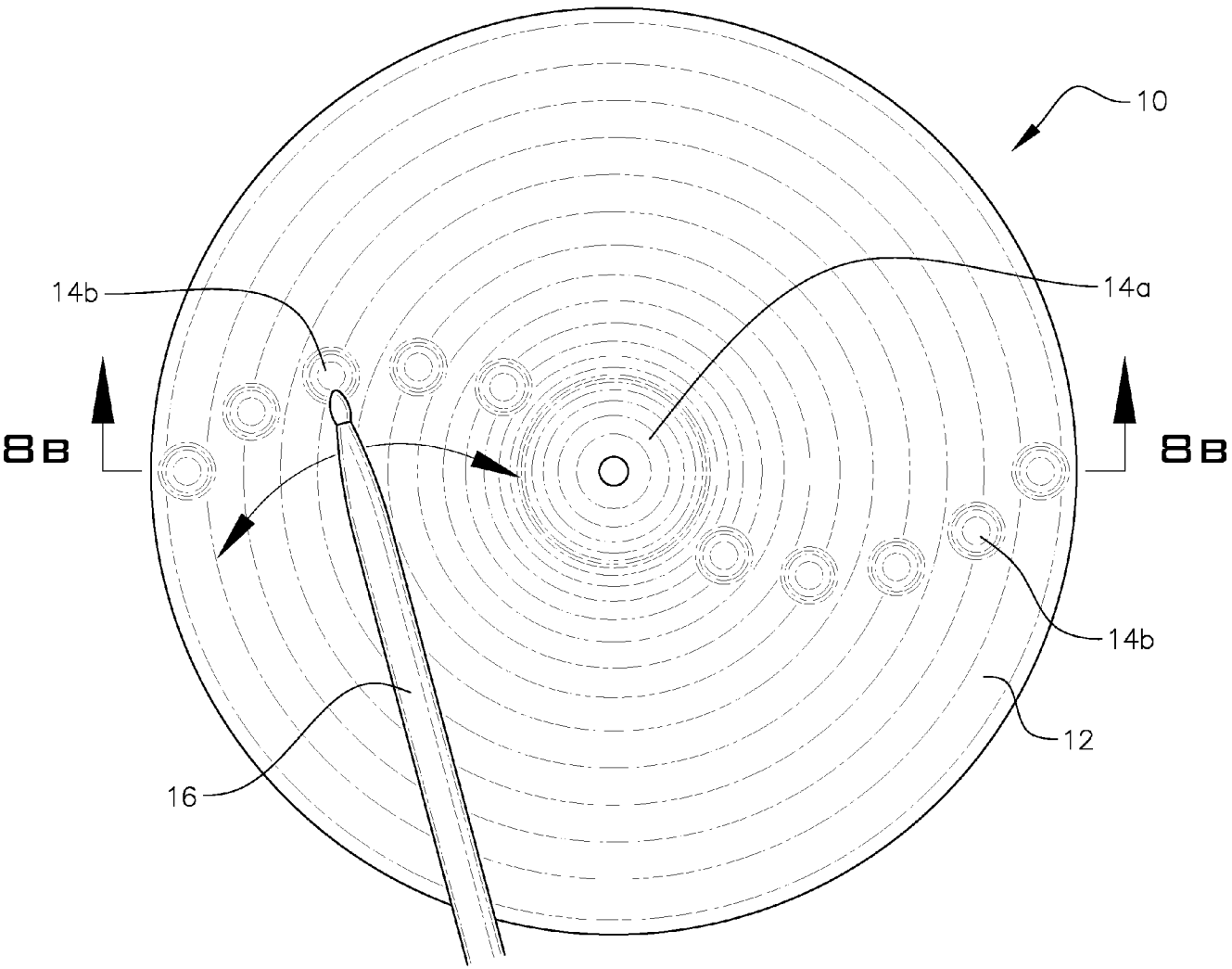
FIG. 8A is a representative conceptual depiction of a cymbal where the combination of two or more small added off center cups in proximity allow a sideways drumstick playing technique known as raking and where one representative example of a pattern that can be provided with the off center cups is one or more of the depicted S-shaped pattern groups.
Figure 8B:
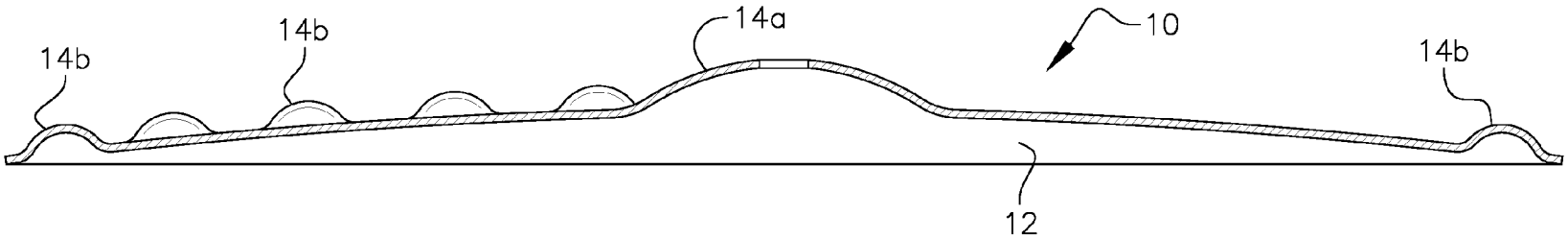
FIG. 8B is a cross-section of the depiction of FIG. 8A.
Figure 8C:
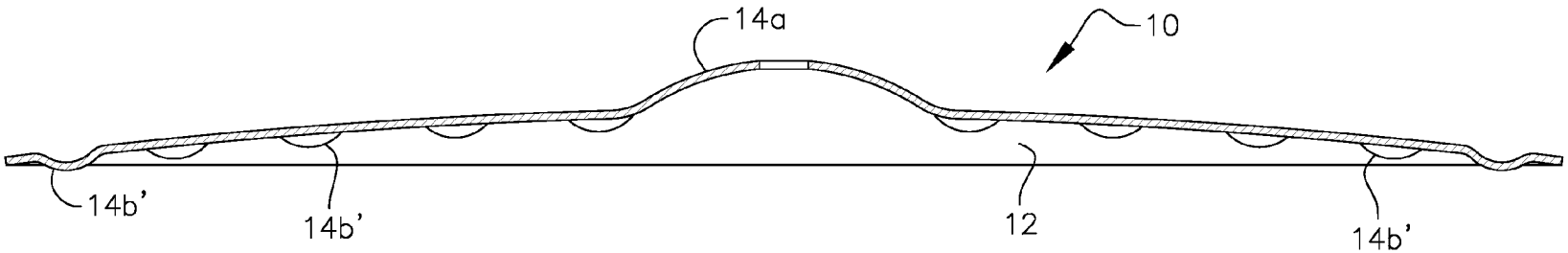
FIG. 8C is a cross-section depiction similar to FIG. 8B except that one or more off center cups have an inverted or downwardly directed form in the main convex surface of the cymbal.

FIG. 8A is a representative conceptual depiction of a cymbal 12 where the combination of two or more small added off center cups 14*b* in proximity allow a sideways drumstick 16 playing technique known as raking and where one representative example of a pattern that can be provided with the off center cups 14*b* is one or more of the depicted S-shaped pattern groups. FIG. 8B is a cross-section of the depiction of FIG. 8A showing upwardly directed cups 14*b* while FIG. 8C is a cross-section depiction similar to FIG. 8B except that one or more off center cups 14*b* have an inverted or downwardly directed form in the main convex surface of the cymbal 12.

Figure 9A:
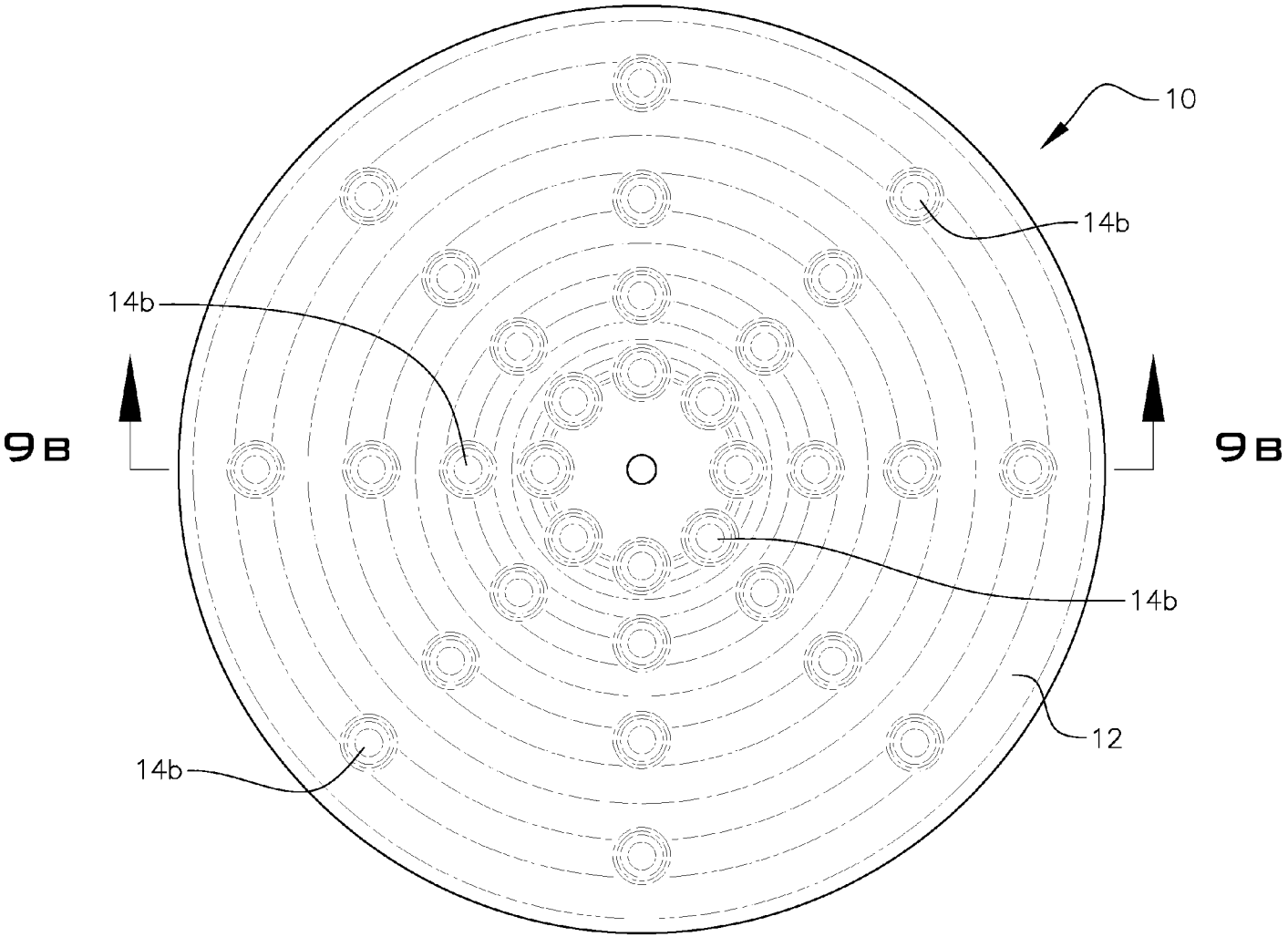
FIG. 9A is a representative conceptual depiction of a cymbal wherein groupings of small cups in the center area affect swell and amplitude and the drawing is also representative of a cymbal wherein a series of small cups in an upward direction (the same direction as the convex-bow of the cymbal), result in a vibrato effect, and the drawing is also representative of a cymbal wherein a series of small cups are located to form a predetermined pattern on the cymbal.
Figure 9B:
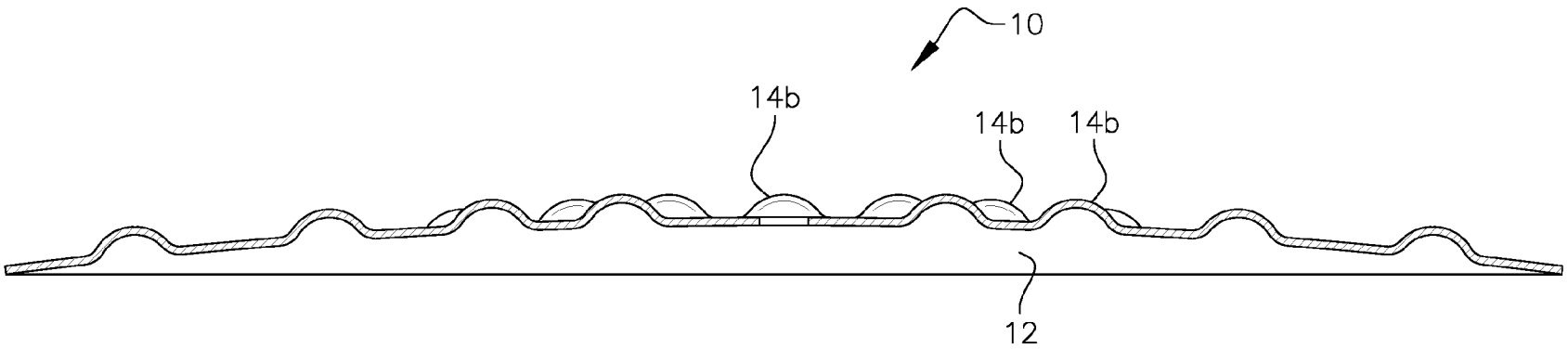
FIG. 9B is a cross-section view of the depiction of FIG. 9A.

FIGS. 9A-9B depict a representative conceptual example of a cymbal 12 wherein groupings of small cups 14*b* in the center area affect swell and amplitude and the drawing is also representative of a cymbal 12 wherein a series of small cups 14*b* in an upward direction (the same direction as the convex bow of the cymbal 12), result in a vibrato effect. This FIG. 9A is also representative of a cymbal 12 wherein a series of small cups 14*b* are located to form a predetermined pattern on the cymbal 12, such as the tight circle of cups around the center area of the cymbal 12 which lacks a center dome cup and/or the a pattern such as the progressive radial lines of cups 14*b*. FIG. 9B is a cross-section view of the depiction of FIG. 9A.

Figure 10A:
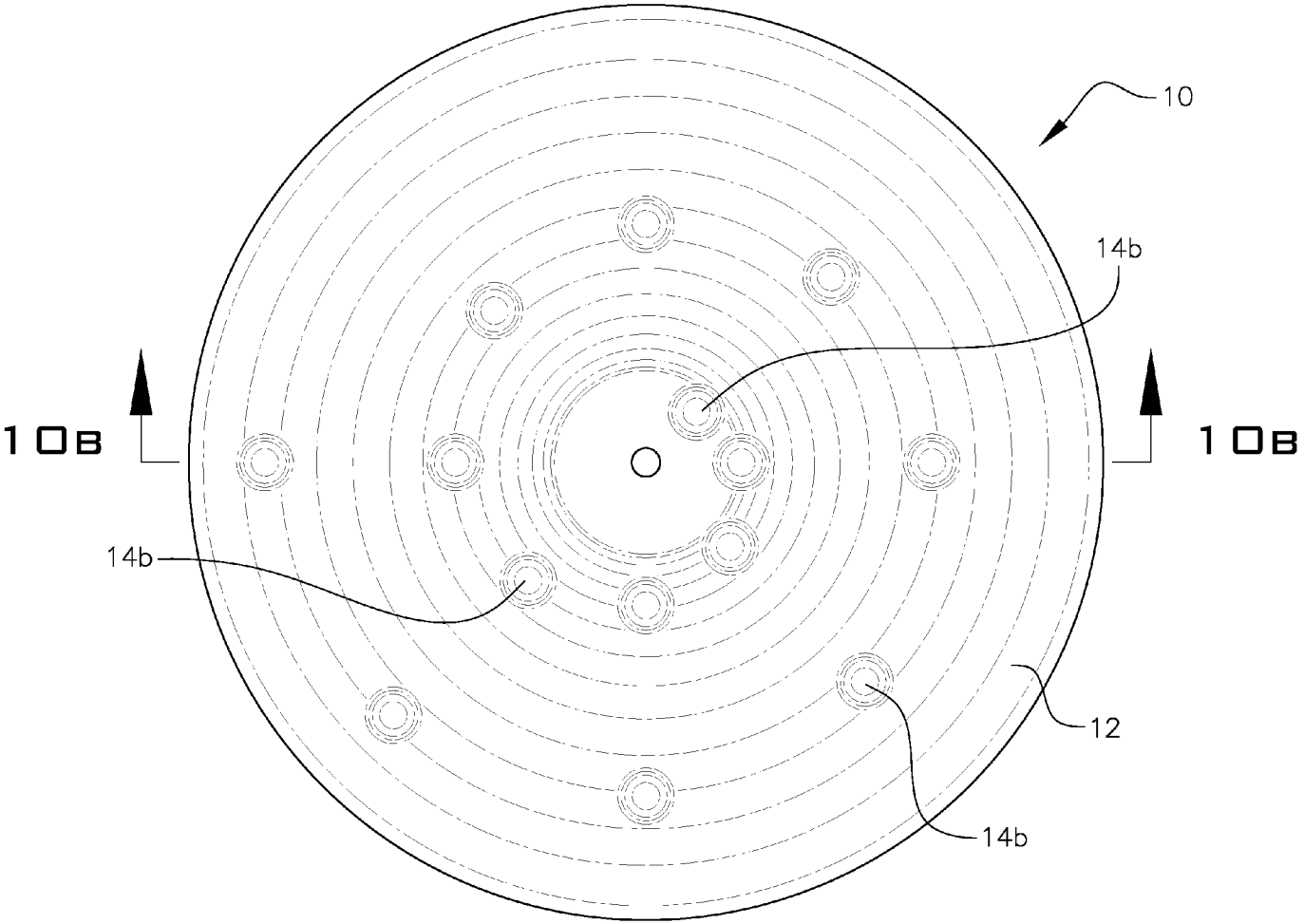
FIG. 10A is a representative conceptual depiction of a cymbal with a series of small cups located to create a predetermined pattern such as a spiral pattern extending outward from center.
Figure 10B:
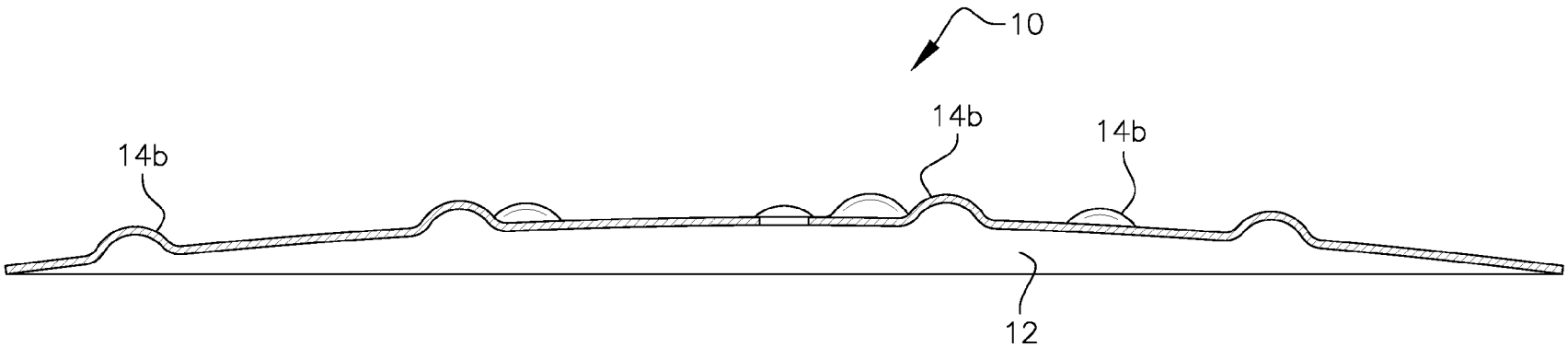
FIG. 10B is a cross-section view of the depiction of FIG. 10A.

FIGS. 10A-10B depict a representative conceptual example of a cymbal 12 with a series of small cups 14*b* located to create a predetermined pattern such as a spiral pattern extending outward from center.

Figure 11A:
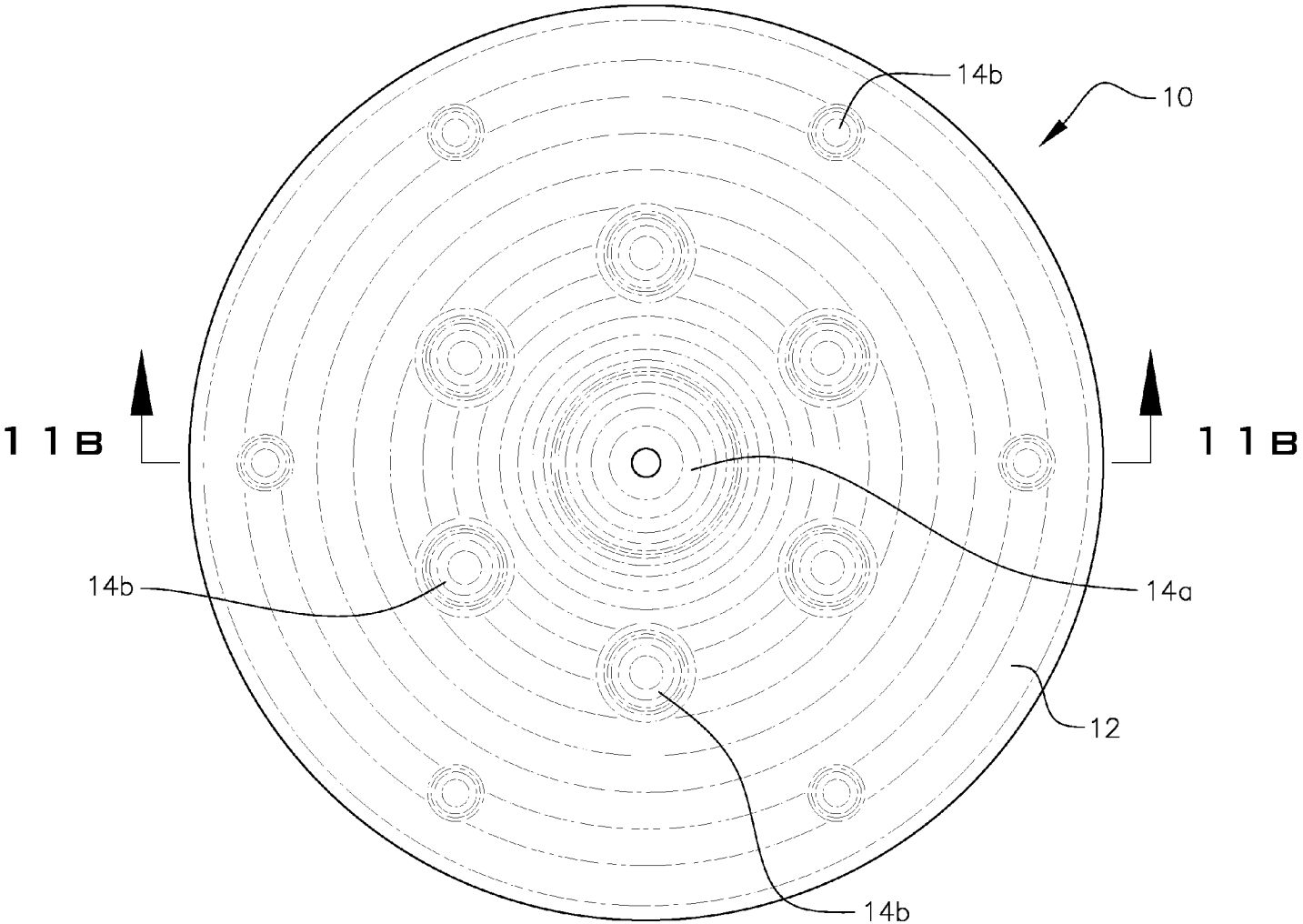
FIG. 11A is a representative conceptual depiction of a cymbal wherein a larger diameter center cup is surrounded by a series of cups which progress outward from center with gradually decreasing diameter.
Figure 11B:
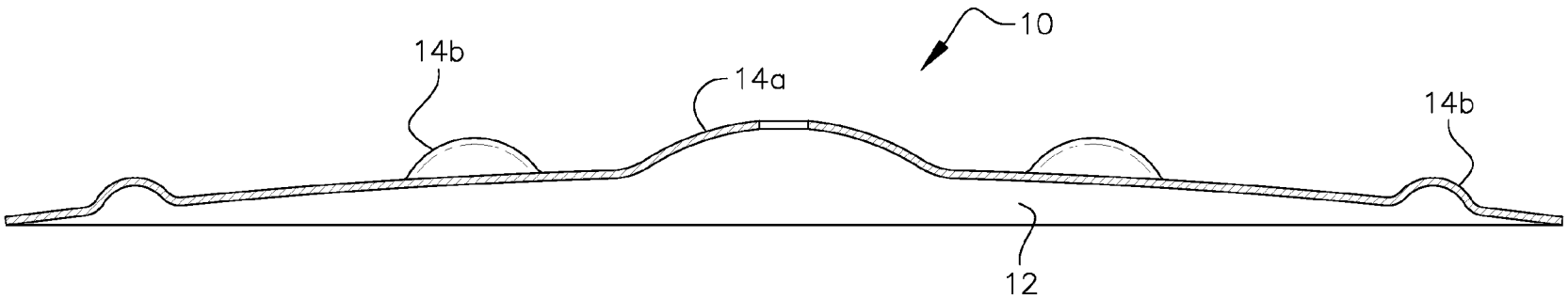
FIG. 11B is a cross-section view of FIG. 11A further providing an example of a cymbal wherein a larger diameter center cup is surrounded by a series of cups which progress outward from center with gradually decreasing diameter.

FIGS. 11A-11B depict a representative conceptual example of a cymbal 12 wherein a larger diameter center cup 14*a* is surrounded by a series of cups 14*b* which progress outward from center with gradually decreasing diameters.

It should be understood that the preceding is merely a detailed description of one or more embodiments of this invention and that numerous changes to the disclosed embodiments can be made in accordance with the disclosure herein without departing from the spirit, and scope of the invention. The preceding description, therefore, is not meant to limit the scope of the invention. Rather, the scope of the invention is to be determined only by the appended claims and their equivalents.

What is claimed is:

1. A cymbal comprising:

a cymbal body having at least two open cups extending therefrom;

wherein at least one of the cups includes metal welded inside said at least one of the cups.

2. A cymbal comprising:

a cymbal body having at least two open cups extending therefrom;

wherein a first one of the at least two cups is a main center cup and a second one of the at least two cups is formed off-center within the main center cup.

3. A cymbal comprising:

a cymbal body having at least two open cups extending therefrom;

wherein a first one of the cups is a main center cup and a second one of the cups is formed within the main center cup, said first one of the cups being located centrally within said main center cup.

4. A cymbal comprising:

a cymbal body having at least two open cups extending therefrom;

wherein the at least two cups are in sufficient proximity to allow a sideways drumstick raking playing technique.

5. The cymbal according to claim 4, wherein at least one of the cups is inverted relative to a main convex surface of said cymbal.

6. A cymbal comprising:

a cymbal body having at least two open cups extending therefrom;

wherein the at least two cups are included in a grouping of small cups in a center area of said cymbal such that said grouping affects swell and amplitude characteristics of said cymbal.

7. A cymbal comprising:

a cymbal body having at least two open cups extending therefrom;

wherein a first one of the cups is a main center cup and a second one of the cups is a smaller cup formed within the main center cup and located centrally therein, said main center cup and said smaller cup having respective dome shapes extending in opposite directions.

8. A cymbal having two or more cups, wherein said cymbal is made from material that includes nickel/iron grain refiners added to phosphor bronze material, said additional nickel/iron grain refiners added to said phosphor bronze material enhances formability and hence enhances sound potential in said cymbal.

9. The cymbal according to claim 4, wherein the at least two cups are included in a series of small cups extending from a convex surface of the cymbal body so as to generate vibrato effect when said cymbal is played.

10. A cymbal comprising:

a cymbal body having at least two open cups extending therefrom;

wherein a first one of the cups is an upward facing cup and a second one of the cups is a downward facing cup centered within the upward facing cup, whereby a smaller center surface contact area is formed so as to reduce damping when said cymbal is in use.

11. A cymbal comprising:

a cymbal body having at least two open cups extending therefrom;

wherein the at least two cups are included in a series of small cups located to create one or more S-shaped groupings.

12. A cymbal comprising:

a cymbal body having at least two open cups extending therefrom;

wherein the at least two cups are included in a series of small cups located to create a spiral pattern extending outward from center.

13. A cymbal comprising:

a cymbal body having at least two open cups extending therefrom;

wherein a first one of the cups is a deeper center cup and a second one of the cups is included in a series of cups which progress outwardly from said deeper center cup with changing depths.

14. A cymbal comprising:

a cymbal body having at least two open cups extending therefrom;

wherein a first one of the cups is a larger diameter center cup and a second one of the cups is included in a series of cups which progress outwardly from said larger diameter center cup with changing diameters.

15. A cymbal comprising:

a cymbal body having at least two open cups extending therefrom;

wherein a first one of the cups is a main center cup and a second one of the cups is a deeper smaller cup centrally located within the main center cup so as to increase the effective depth of the main center cup thereby stabilizing cymbal balance during use.

* * * * *